US009640187B2

(12) United States Patent
Niemisto et al.

(10) Patent No.: US 9,640,187 B2
(45) Date of Patent: May 2, 2017

(54) METHOD AND AN APPARATUS FOR PROCESSING AN AUDIO SIGNAL USING NOISE SUPPRESSION OR ECHO SUPPRESSION

(75) Inventors: Riitta Elina Niemisto, Tampere (FI); Robert Bregovic, Vinica (HR); Bogdan Dumitrescu, Tampere (FI); Ville Mikael Myllyla, Tampere (FI)

(73) Assignee: Nokia Technologies Oy, Espoo (FI)

( * ) Notice: Subject to any disclaimer, the term of this patent is extended or adjusted under 35 U.S.C. 154(b) by 1016 days.

(21) Appl. No.: 13/394,783

(22) PCT Filed: Sep. 7, 2010

(86) PCT No.: PCT/IB2010/054033
§ 371 (c)(1),
(2), (4) Date: Apr. 18, 2012

(87) PCT Pub. No.: WO2011/027337
PCT Pub. Date: Mar. 10, 2011

(65) Prior Publication Data

US 2013/0035777 A1 Feb. 7, 2013

(30) Foreign Application Priority Data

Sep. 7, 2009 (GB) ..... 0915595.3

(51) Int. Cl.
*G10L 19/02* (2013.01)
*G10L 21/0208* (2013.01)

(52) U.S. Cl.
CPC ..... *G10L 19/0204* (2013.01); *G10L 21/0208* (2013.01)

(58) Field of Classification Search
CPC . G10H 2240/251; G10L 19/012; G10L 19/02; G10L 19/0204; G10L 19/0208;
(Continued)

(56) References Cited

U.S. PATENT DOCUMENTS 5,806,025 A 9/1998 Vis et al.
5,839,101 A 11/1998 Vahatalo et al.
(Continued)

FOREIGN PATENT DOCUMENTS

CN 101227537 7/2008
CN 101477800 7/2009
(Continued)

OTHER PUBLICATIONS

R. David Koilpillai et al., Cosine-Modulated FIR Filter Banks Satisfying Perfect Reconstruction, Apr. 1992 IEEE Transactions on Signal Processing, vol. 40, No. 4 http://authors.library.caltech.edu/6848/1/KOIieeetsp92.pdf.*
(Continued)

*Primary Examiner* — Paul McCord
*Assistant Examiner* — Alexander Eljaiek
(74) *Attorney, Agent, or Firm* — Alston & Bird LLP

(57) ABSTRACT

The invention relates to a method and an apparatus for processing an audio signal, wherein the method comprises the steps of: filtering an audio signal into at least two frequency band signals, generating for each frequency band signal a plurality of sub-band signals, wherein for at least one frequency band signal the plurality of sub-band signals are generated using a time to frequency domain transform and for the at least one other frequency band the plurality of sub-band signals for the other frequency band are generated using a sub-band filterbank, and the apparatus comprises at least one processor and at least one memory including computer program code, the at least one memory and the computer program code being configured to, with the at least one processor, cause the apparatus to perform the method.

24 Claims, 6 Drawing Sheets

(58) Field of Classification Search
CPC ... G10L 19/0212; G10L 19/16; G10L 19/173; G10L 19/20; G10L 19/24; G10L 21/0208; G10L 21/038; H01P 1/213; H04R 29/00
USPC .... 379/392.01; 381/56, 94.1, 94.2, 94.3, 98; 700/94; 704/226, E19.044, E21.011
See application file for complete search history.

(56) References Cited

U.S. PATENT DOCUMENTS

| | | | | |
|---|---|---|---|---|
| 6,868,377 | B1 | 3/2005 | Laroche | |
| 8,463,603 | B2 * | 6/2013 | Gao | 704/226 |
| 2005/0004794 | A1 * | 1/2005 | Son et al. | 704/219 |
| 2005/0027520 | A1 | 2/2005 | Mattila et al. | |
| 2007/0078645 | A1 | 4/2007 | Niemisto et al. | |
| 2007/0288235 | A1 * | 12/2007 | Vaananen et al. | 704/229 |
| 2008/0172223 | A1 * | 7/2008 | Oh et al. | 704/205 |
| 2008/0189116 | A1 | 8/2008 | Leblanc et al. | |
| 2008/0281604 | A1 * | 11/2008 | Choo et al. | 704/500 |
| 2009/0141907 | A1 * | 6/2009 | Kim et al. | 381/71.7 |

FOREIGN PATENT DOCUMENTS

| | | |
|---|---|---|
| EP | 0858159 | 8/1998 |
| GB | 2 437 559 A | 10/2007 |
| GB | 2437559 A | 10/2007 |

OTHER PUBLICATIONS

International Search Report and Written Opinion received for corresponding Patent Cooperation Treaty Application No. PCT/IB2010/054033, dated Dec. 21, 2010, 13 pages.

Ted Painter et al. "Perceptual Coding of Digital Audio", Proceedings of the IEEE, vol. 88, No. 4 Apr. 2000, pp. 451-513, chapter III,section A, B; chapter IV, p. 474; chapter V, p. 479.

International Preliminary Report on Patentability received for corresponding Patent Cooperation Treaty Application No. PCT/IB2010/054033, dated Mar. 12, 2012, 7 pages.

Extended European Search Report for corresponding European Application No. EP 10813426, dated May 3, 2013, 7 pages.

Brandenburg K. et al. "Second Generation Perceptual Audio Coding: the Hybrid Coder", Preprints of Papers Presented at the AES Convention, Mar. 13, 1990 pp. 1-12.

Office Action received for corresponding Russian Application No. 2012113254, dated Apr. 22, 2013, 6 pages.

"Uniform and warped low delay filter-banks for speech enhancement", Speech Communication, vol. 49, Issue 7-8, Jul. 2007, pp. 574-587.

Search Report received for corresponding United Kingdom Patent Application No. 0915595.3, dated Jan. 22, 2010, 3 pages.

Search Report for Great Britain Application No. GB0915595.3; dated Jan. 21, 2010.

Zelniker, G. et al., Advanced Digital Signal Processing—Theory and Applications (1994) pp. 373-376.

Office Action for corresponding Chinese Application No. 201080045655.0 dated May 29, 2014.

Office Action for corresponding European Patent Application No. 10813426.3 dated Aug. 11, 2016.

Dreiseitel, Pia et al.: "*Speech Enhancement for Mobile Telephony Based on Non- Resolution*"; 9th European Signal Processing Conference (EUSIPCO 1998); IEEE; Sep. 8, 1998; pp. 1-4; XP032766924.

Dreiseitel, Pia et al.: "*Acoustic Echo and Noise Control—A Long Lasting Chall*"; Conference (EUSIPCO 1998); IEEE; Sep. 8, 9th European Signal Processing 1998; pp. 1-8; XP032767211.

* cited by examiner

METHOD AND AN APPARATUS FOR PROCESSING AN AUDIO SIGNAL USING NOISE SUPPRESSION OR ECHO SUPPRESSION

RELATED APPLICATION

This application was originally filed as PCT Application No. PCT/IB2010/054033, filed Sep. 7, 2010, which claims priority benefit to Great Britain Patent Application Number 0915595.3, filed Sep. 7, 2009.

TECHNICAL FIELD

The present application relates to apparatus for the processing of audio signals. The application further relates to, but is not limited to, apparatus for processing audio signals in mobile devices.

BACKGROUND

Electronic apparatus and in particular mobile or portable electronic apparatus may be equipped with integral microphone apparatus or suitable audio inputs for receiving a microphone signal. This permits the capture and processing of suitable audio signals for processing, encoding, storing, or transmitting to further devices. For example cellular telephones may have microphone apparatus configured to generate an audio signal in a format suitable for processing and transmitting via the cellular communications network to a further device, the signal at the further device may then be decoded and passed to a suitable listening apparatus such as a headphone or loudspeaker. Similarly some multimedia devices are equipped with mono or stereo microphone apparatus for audio capture of events for later playback or transmission.

The electronic apparatus can further comprise microphone apparatus or inputs for receiving audio signals from one or more microphones and may perform some pre-encoding processing to reduce noise. For example the analogue signal may be converted to a digital format for further processing.

This pre-processing may be required when attempting to record full spectral band audio signals from a far audio signal source, the desired signals may be weak compared to background or interference noises. Some noise is external to the recorder and may be known as stationary acoustic background or environmental noise.

Typical sources of such stationary acoustic background noise are fans such as air conditioning units, projector fans, computer fans, or other machinery. Examples of machinery noise are, for example, domestic machinery such as washing machines and dishwashers, vehicle noise such as traffic noise. Further sources of interference may be from other people in the near environment, for example humming from people neighbouring the recorder at the concert, or natural noise such as wind passing through trees.

Other interference noise may be internal to the system. The Noise suppressor circuitry typically operates in the frequency domain utilizing Fast Fourier Transforms (FFT) in order to obtain sufficient frequency resolution. Since wideband signals have double the number of samples compared to narrowband signals (typically for mobile device speech applications a 8 kHz sampling frequency is defined as narrowband a 16 kHz sampling frequency is defined as wideband), the FFT length has to be doubled. This roughly doubles the needed amount of computation and memory required to process the wideband audio signals, but due to the fixed point processing the same level of H-T-accuracy cannot be provided as provided in narrowband processing.

Finite precision of audio signals also produces quantization noise. The quantization noise, when significant becomes audible and renders the listening of the signal as difficult and annoying. In speech systems this happens for example when the audio signals are processed as wideband signals (in other words having a 16 kHz sampling frequency), but only have narrowband content (in other words no significant content above 4 kHz). This situation has generally been ignored as it was assumed that it would occur infrequently, but implemented systems show that this situation may happen quite frequently. For example if a phone carrying a wideband call is attached to a Bluetooth accessory which is only narrowband capable, then only narrowband content is carried by the wideband call. Moreover, it has been observed that the quantization noise may be audible even when signals processed are true wideband signals.

Although it may be possible to use FFT with better quality to produce a partial solution it has been observed that it is impossible to solve the problem using FFT alone without using significant amount of memory and processing power and therefore having significant effect on battery power and cost for mobile devices.

The usage of two channel analysis-synthesis filterbanks that divide a wideband signal to two signals: low band and high band, has been considered as a basis of processing. However typically there is decimation of the high and low bands with aliasing compensation.

Audio signal processing of these audio signals should follow the following criteria:

1. Audio quality (the audio signal should not be distorted);
2. Memory (the filterbank should not require large amounts of memory to store the filter bank configuration in other words the filter should not need to store large numbers of values);
3. Computational complexity (the filterbank should not be sufficiently complex to require significant processor capability and thus increase the power drain on the battery for the mobile device or similar); and
4. Delay (there should not be a significantly large delay in processing as this may affect the communications pathway).

Known techniques typically produce significant amounts of quantization noise or for a suitable computation complexity and memory cannot produce sufficient quality for wideband speech purposes. Other approaches are known to require very narrow bands to be set on the filters for the low frequencies. In order to produce sufficient frequency resolution on low frequencies, many filters would be required which would be expensive in both memory and computational capacity. Further approaches produce significantly long delays and have insufficient frequency resolution for high band signals.

SUMMARY

This application proceeds from the consideration that an improved filter bank structure may be configured to have tolerable delay, memory requirements and computational complexity without sacrificing audio quality. Furthermore the structure and apparatus is designed so that besides noise suppression, other audio processing may utilise the filterbank structure and thus may save computational and memory capacity on a processor system.

There is provided according to an aspect of the invention a method comprising: filtering an audio signal into at least two frequency band signals; and generating for each frequency band signal a plurality of sub-band signals; wherein for at least one frequency band signal the plurality of sub-band signals are generated using a time to frequency domain transform and for at least one other frequency band the plurality of sub-band signals for the one other frequency band are generated using a sub-band filterbank.

The time to frequency domain transform may comprise at least one of: a fast Fourier transform; a discrete Fourier transform; and a discrete cosine transform.

The sub-band filterbank may comprise a cosine based modulated filterbank.

Filtering an audio signal into at least two frequency band signals may comprise: high-pass filtering the audio signal into a first of at least two frequency band signals; low-pass filtering the audio signal into a low-pass filtered signal; and downsampling the low-pass filtered audio signal to generate a second of the at least two frequency band signals.

Downsampling the low-pass filtered audio signal to generate a second of the at least two frequency band signals is preferably by a factor of 2.

The method may further comprise: processing at least one sub-band signal from at least one frequency band; combining the sub-band signals to form at least two processed frequency band audio signals; and combining the at least two processed frequency band audio signals to generate a processed audio signal.

Processing at least one sub-band signal from at least one frequency band may comprise applying noise suppression to the at least one sub-band signal from the at least one frequency signal.

Combining the sub-band signals to form at least two processed frequency signals may comprise: generating using a frequency to time domain transform a first of the at least two processed frequency bands from a first set of sub-band signals; and summing a second set of sub-band signals to form a second of the at least two processed frequency bands.

The first set of sub-band signals are preferably associated with the plurality of sub-band signals generated using a time to frequency domain transform, and the second set of sub-band signals are preferably associated with the plurality of sub-band signals generated using a sub-band filterbank.

Combining the at least two processed frequency band audio signals to generate a processed audio signal may further comprise: upsampling a first of the at least two processed frequency band signals; low pass filtering the upsampled first of the at least two processed frequency band signals; and combining the low pass filtered, upsampled, first of the at least two processed frequency band signals with a second of the at least two processed frequency band signals to generate the processed audio signal.

Upsampling a first of the at least two processed frequency band signals is preferably by a factor of 2.

Combining the at least two processed frequency band audio signals to generate a processed audio signal may further comprise delaying the second of the at least two processed frequency band signals so to synchronize the low pass filtered, upsampled, first of the at least two processed frequency band signals with the second of the at least two processed frequency band signals.

The method may further comprise, prior to combining the at least two processed frequency band audio signals to generate a processed audio signal, processing the sub-band signals, wherein the processing of the sub-band signals comprises signal level control on the sub-band signals.

The method may further comprise configuring filters which preferably comprises: a first filter for the high-pass filtering of the audio signal into a first of at least two frequency band signals; a second filter for the low-pass filtering of the audio signal into a low-pass filtered signal; and a third filter for the low pass filtering of the upsampled first of the processed frequency band signals.

Configuring the first set of filters may comprise configuring at least one filter parameter for the first and second filters by minimizing a stop band energy for the first and second filters with only one distortion.

Configuring the first set of filters may comprise carrying out for at least one iteration of the operations of configuring at least one filter parameter for the second and third filters while keeping filter parameters for the first filter fixed and then configuring at least one filter parameter for the first and second filters while keeping filter parameters for the third filter fixed.

The method may further comprise: processing the at least two frequency band signals prior to generating for each frequency band signal a plurality of sub-band signals, wherein the processing of the at least two frequency band signals preferably comprises at least one of: audio beamforming processing; and adaptive filtering.

According to a second aspect of the application there is provided an apparatus comprising at least one processor and at least one memory including computer program code the at least one memory and the computer program code configured to, with the at least one processor, cause the apparatus at least to perform: filtering an audio signal into at least two frequency band signals; and generating for each frequency band signal a plurality of sub-band signals; wherein for at least one frequency band signal the plurality of sub-band signals are generated using a time to frequency domain transform and for at least one other frequency band the plurality of sub-band signals for the one other frequency band are generated using a sub-band filterbank.

The time to frequency domain transform may comprise at least one of: a fast Fourier transform; a discrete Fourier transform; and a discrete cosine transform.

The sub-band filterbank may comprise a cosine based modulated filterbank.

Filtering an audio signal into at least two frequency band signals may further comprise causing the apparatus to perform: high-pass filtering the audio signal into a first of at least two frequency band signals; low-pass filtering the audio signal into a low-pass filtered signal; and downsampling the low-pass filtered audio signal to generate a second of the at least two frequency band signals.

Downsampling the low-pass filtered audio signal to generate a second of the at least two frequency band signals may further comprise causing the apparatus to perform the downsampling by a factor of 2.

The at least one processor may cause the apparatus at least to further perform: processing at least one sub-band signal from at least one frequency band; combining the sub-band signals to form at least two processed frequency band audio signals; and combining the at least two processed frequency band audio signals to generate a processed audio signal.

Processing at least one sub-band signal from at least one frequency band may further comprise causing the apparatus to perform applying noise suppression to the at least one sub-band signal from the at least one frequency signal.

Causing the apparatus to perform combining the sub-band signals to form at least two processed frequency signals may further comprise causing the apparatus to perform: generating using a frequency to time domain transform a first of the at least two processed frequency bands from a first set of sub-band signals; and summing a second set of sub-band signals to form a second of the at least two processed frequency bands.

The first set of sub-band signals are preferably associated with the plurality of sub-band signals generated using a time to frequency domain transform, and the second set of sub-band signals are preferably associated with the plurality of sub-band signals generated using a sub-band filterbank.

Causing the apparatus to perform combining the at least two processed frequency band audio signals to generate a processed audio signal may further comprise causing the apparatus to perform: upsampling a first of the at least two processed frequency band signals; low pass filtering the upsampled first of the at least two processed frequency band signals; and combining the low pass filtered, upsampled, first of the at least two processed frequency band signals with a second of the at least two processed frequency band signals to generate the processed audio signal.

Causing the apparatus to perform upsampling the first of the at least two processed frequency band signals may further comprise causing the apparatus to perform the upsampling by a factor of 2.

Causing the apparatus to perform combining the at least two processed frequency band audio signals to generate a processed audio signal may further comprise causing the apparatus to perform delaying the second of the at least two processed frequency band signals so to synchronize the low pass filtered, upsampled, first of the at least two processed frequency band signals with the second of the at least two processed frequency band signals.

The at least one processor may cause the apparatus at least to further perform processing the sub-band signals prior to combining the at least two processed frequency band audio signals to generate a processed audio signal, wherein the processing of the sub-band signals comprises signal level control on the sub-band signals.

The at least one processor may cause the apparatus at least to further perform configuring filters, the filters may comprise: a first filter for the high-pass filtering of the audio signal into a first of at least two frequency band signals; a second filter for the low-pass filtering of the audio signal into a low-pass filtered signal; and a third filter for the low pass filtering of the upsampled first of the processed frequency band signals.

Configuring the first set of filters may comprise causing the apparatus to perform configuring at least one filter parameter for the first and second filters by minimizing a stop band energy for the first and second filters with only one distortion.

Configuring the first set of filters may comprise causing the apparatus to perform: carrying out for at least one iteration of the operations of configuring at least one filter parameter for the second and third filters while keeping filter parameters for the first filter fixed and then configuring at least one filter parameter for the first and second filters while keeping filter parameters for the third filter fixed.

The at least one processor may cause the apparatus at least to further perform: processing the at least two frequency band signals prior to generating for each frequency band signal a plurality of sub-band signals, wherein the processing of the at least two frequency band signals may comprise at least one of: audio beamforming processing; and adaptive filtering.

According to a third aspect of the invention there is provided an apparatus comprising: filtering means configured to filter an audio signal into at least two frequency band signals; and processing means for generating for each frequency band signal a plurality of sub-band signals; wherein for at least one frequency band signal the plurality of sub-band signals are generated using a time to frequency domain transform and for at least one other frequency band the plurality of sub-band signals for the one other frequency band are generated using a sub-band filterbank.

According to a fourth aspect of the invention there is provided an apparatus comprising a filter configured to filter an audio signal into at least two frequency band signals; a time to frequency domain transformer configured to generating for at least one frequency band signal a plurality of sub-band signals; and a sub-band filterbank configured to generate for at least one other frequency band the plurality of sub-band signals.

According to a fifth aspect of the invention there is provided a computer-readable medium encoded with instructions that, when executed by a computer, perform: filtering an audio signal into at least two frequency band signals; and generating for each frequency band signal a plurality of sub-band signals; wherein for at least one frequency band signal the plurality of sub-band signals are generated using a time to frequency domain transform and for at least one other frequency band the plurality of sub-band signals for the one other frequency band are generated using a sub-band filterbank.

The apparatus as described above may comprise an encoder.

An electronic device may comprise apparatus as described above.

A chipset may comprise apparatus as described above.

Embodiments of the present invention aim to address the above problem.

BRIEF DESCRIPTION OF THE DRAWINGS

For better understanding of the present invention, reference will now be made by way of example to the accompanying drawings in which.

DETAILED DESCRIPTION

Figure 1:
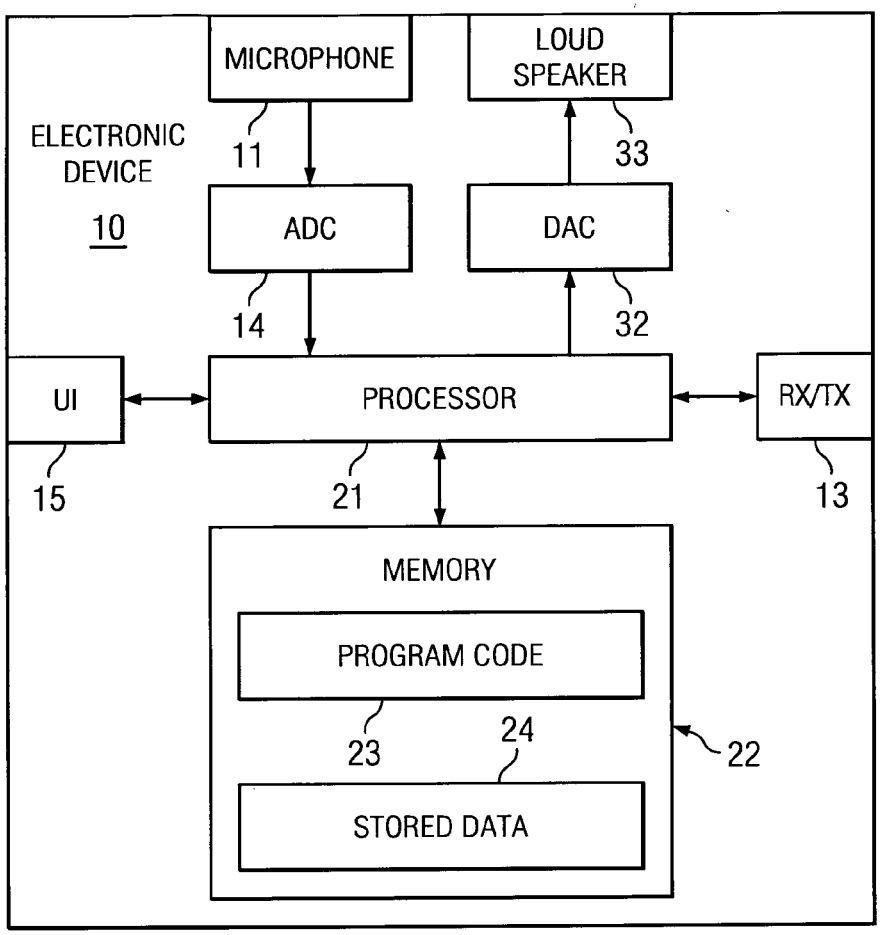
FIG. 1 shows schematically an electronic device employing embodiments of the invention.

The following describes apparatus and methods for the provision of improved audio enhancement processors suitable for operating audio enhancement algorithms. In this regard reference is first made to FIG. 1 schematic block diagram of an exemplary electronic device 10 or apparatus, which incorporates audio enhancement algorithms according to some embodiments of the application.

The electronic device 10 is in some embodiments a mobile terminal, mobile phone or user equipment for operation in a wireless communication system.

The electronic device 10 comprises a microphone 11, which is linked via an analogue-to-digital converter 14 to a processor 21. The processor 21 is further linked via a digital-to-analogue converter 32 to loudspeakers 33. The processor 21 is further linked to a transceiver (TX/RX) 13, to a user interface (UI) 15 and to a memory 22.

The processor 21 may be configured to execute various program codes 23. The implemented program codes 23, in some embodiments, comprise audio capture digital processing or configuration code. The implemented program codes 23 in some embodiments further comprise additional code for further processing of the audio signal. The implemented program codes 23 may in some embodiments be stored for example in the memory 22 for retrieval by the processor 21 whenever needed. The memory 22 in some embodiments may further provide a section 24 for storing data, for example data that has been processed in accordance with the application.

The apparatus capable of implementing audio enhancement algorithms in some embodiments may be implemented in at least partially in hardware without the need of software or firmware.

The user interface 15 in some embodiments enables a user to input commands to the electronic device 10, for example via a keypad, and/or to obtain information from the electronic device 10, for example via a display. The transceiver 13 enables a communication with other electronic devices, for example via a wireless communication network.

It is to be understood again that the structure of the electronic device 10 could be supplemented and varied in many ways.

A user of the electronic device 10 may use the microphone 11 for inputting speech that is to be transmitted to some other electronic device or that is to be stored in the data section 24 of the memory 22. A corresponding application in some embodiments may be activated to this end by the user via the user interface 15. This application, which may in some embodiments be run by the processor 21, causes the processor 21 to execute the code stored in the memory 22.

The analogue-to-digital converter 14 may be configured in some embodiments to convert the input analogue audio signal into a digital audio signal and provide the digital audio signal to the processor 21.

The processor 21 may then process the digital audio signal in the same way as described with reference to FIGS. 2 and 3.

The resulting bit stream may in some embodiments be provided to the transceiver 13 for transmission to another electronic device. Alternatively, the coded data could be stored in the data section 24 of the memory 22, for instance for a later transmission or for a later presentation by the same electronic device 10.

The electronic device 10 may in some embodiments also receive a bit stream with audio signal data from another electronic device via its transceiver 13. In these embodiments, the processor 21 executes the processing program code stored in the memory 22. The processor 21 may then in these embodiments process the received data, and may provide the decoded data to the digital-to-analogue converter 32. The digital-to-analogue converter 32 may in some embodiments convert digital data into analogue audio data and output the audio data via the loudspeakers 33. Execution of the received audio processing program code could in some embodiments be triggered as well by an application that has been called by the user via the user interface 15.

Figure 2:
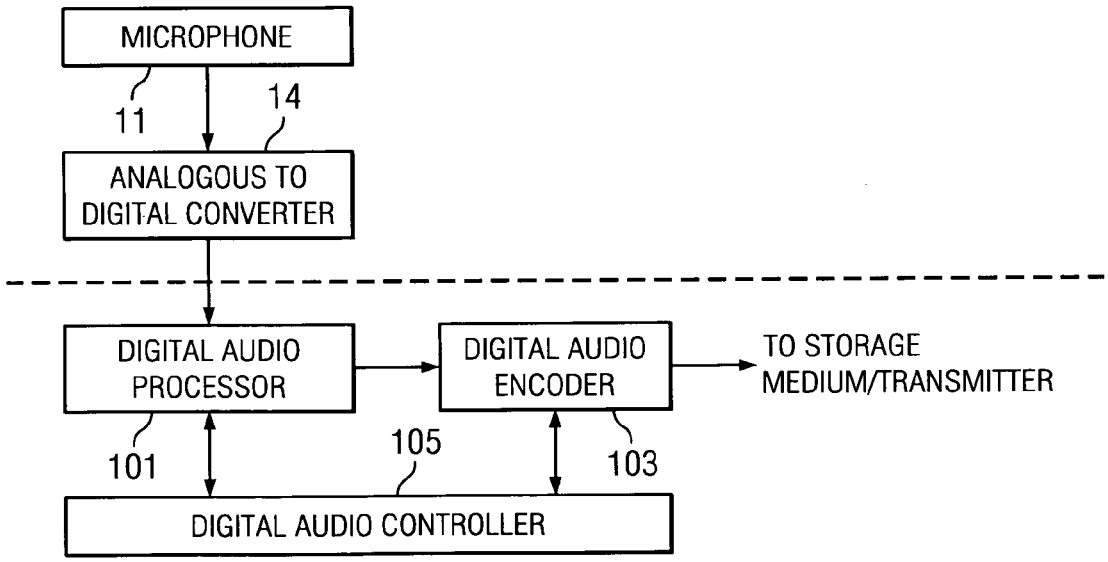
FIG. 2 shows schematically an audio enhancement system employing some embodiments of the present invention.
Figure 3:
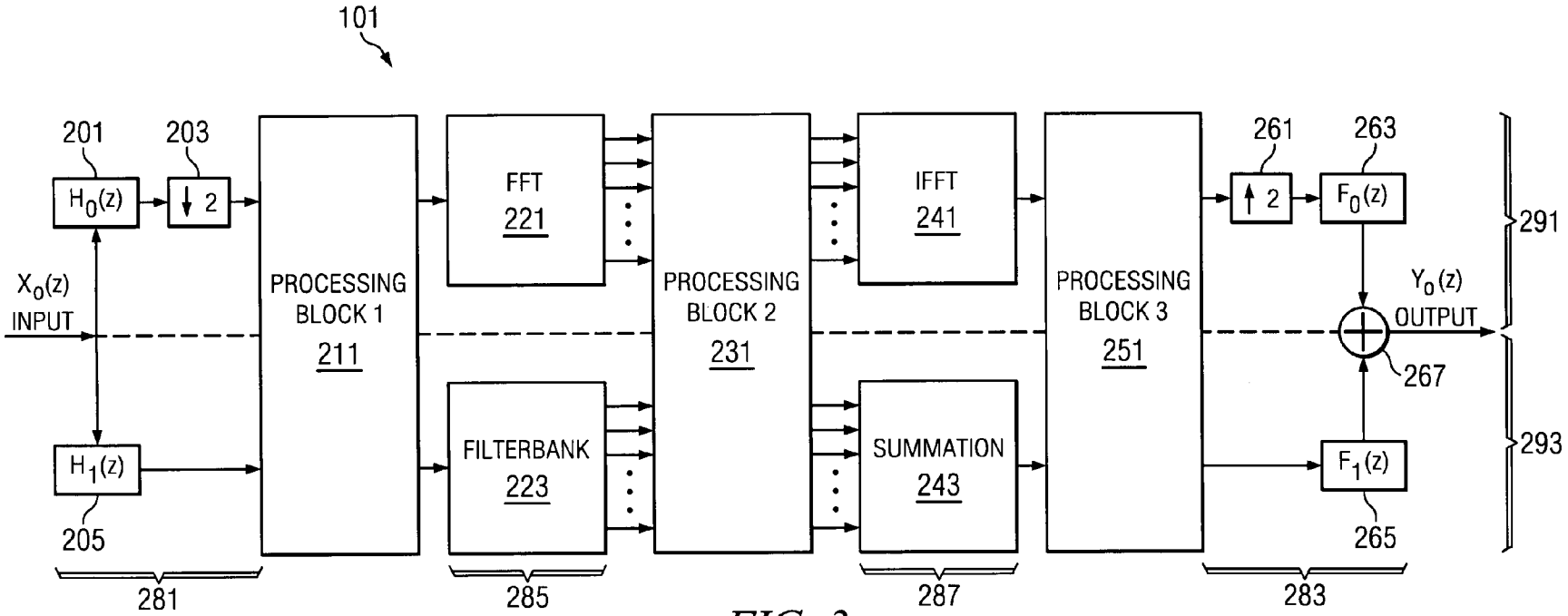
FIG. 3 shows schematically an audio enhancement digital processor according to some embodiments of the invention.

In some embodiments the received signal may be processed to remove noise from the recorded audio signal in a manner similar to the processing of the audio signal received from the microphone 11 and analogue to digital converter 14 and with reference to FIGS. 2 and 3.

The received processed audio data may in some embodiments also be stored instead of an immediate presentation via the loudspeakers 33 in the data section 24 of the memory 22, for instance for enabling a later presentation or a forwarding to still another electronic device.

Figure 4:
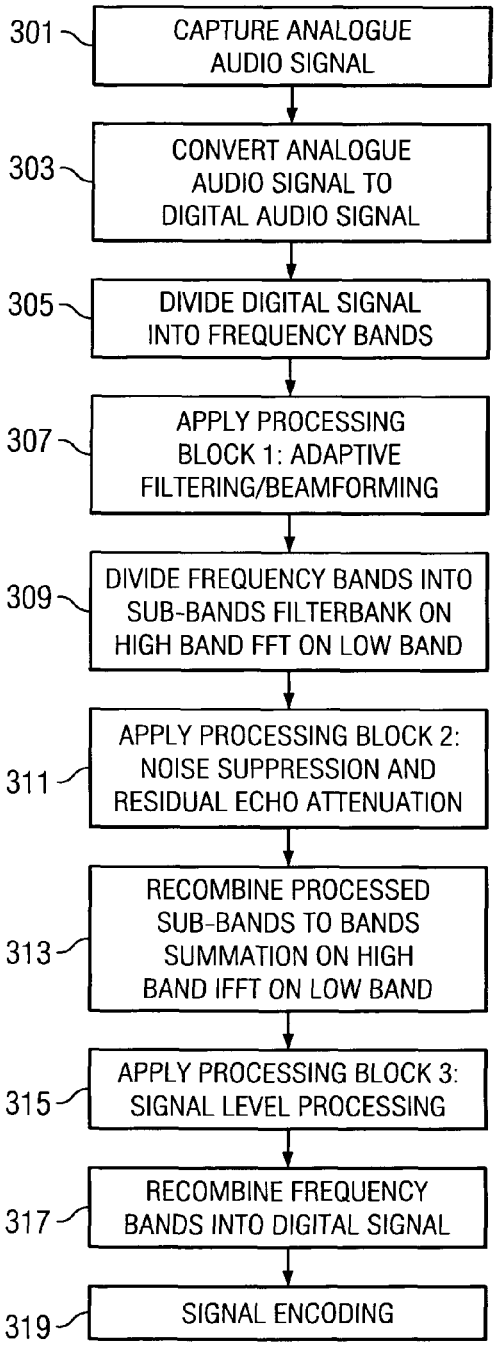
FIG. 4 shows a flow diagram illustrating the operation of the audio enhancement system as shown in FIGS. 2 and 3.
Figure 5:
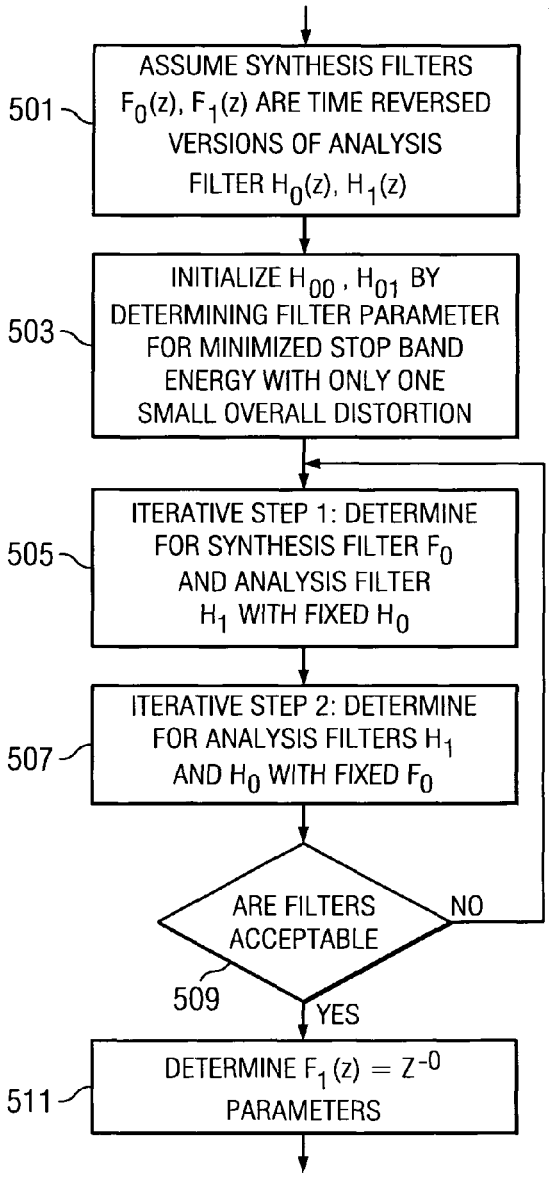
FIG. 5 shows a flow diagram illustrating the determination of the audio enhancement digital processor filter parameters according to some embodiments of the invention.

It would be appreciated that the schematic structures described in FIGS. 2 and 3 and the method steps in FIGS. 4 and 5 represent only a part of the operation of a complete system comprising some embodiments of the application as shown implemented in the electronic device shown in FIG. 1.

FIG. 2 shows a schematic configuration for audio enhancement apparatus for speech including a microphone 11, analogue to digital converter 14, digital audio processor 101, digital audio controller 105 and digital audio encoder 103. In some embodiments of the application the audio enhancement apparatus may comprise some but not all of the above parts. For example in some embodiments the said apparatus may comprise only the digital audio processor 101 where a digital signal from an external source is input to the digital audio processor 101 with preconfigured structure and filter parameters and the digital audio processor 101 further outputs an audio processed signal to an external encoder. In other embodiments of the invention the digital audio processor 101 may be the 'core' element of the audio enhancement apparatus and other parts may be added or removed dependent on the application.

Where elements similar to those shown in FIG. 1 are described, the same reference numbers are used. The microphone 11 receives the audio waves and converts them into analogue electrical signals. The microphone 11 may be any suitable acoustic to electrical transducer. Examples of possible microphones may be capacitor microphones, electric microphones, dynamic microphones, carbon microphones, piezo-electric microphones, fibre optical microphones, liquid microphones, and micro-electrical-mechanical system (MEMS) microphones.

The capture of the analogue audio signal from the audio sound waves is shown with respect to FIG. 4 in step 301.

The electrical signal may be passed to the analogue to digital converter (ADC) 14.

The analogue to digital converter 14 may be any suitable analogue to digital converter for converting the analogue electrical signals from the microphone and outputting a digital signal. The analogue to digital converter may output a digital signal in any suitable form. Furthermore the analogue to digital converter 14 may be a linear or non linear analogue to digital converter dependent on the embodiment. For example the analogue to digital converter may in some embodiments be a logarithmic response analogue to digital converter. The digital output may be passed to the digital audio processor 101.

The conversion of the analogue audio signal to a digital signal is shown in FIG. 4 by step 303.

The digital audio processor 101 may be configured to process the digital signal to attempt to improve the signal to noise and interference ratio of the audio source against the various noise or interference sources.

The digital audio processor 101 may in some embodiments combine FFT based processing with filter bank based processing. In these embodiments the digital audio signal is first split into two channels or frequency bands so that there is a first decimated low frequency band signal and a second undecimated high frequency band signal. Furthermore in these embodiments FFT-based processing is used only on the low frequency band signal, in other words on the lower frequency components of the audio/speech signal, where high frequency resolution is needed. In these embodiments the high frequency band is further divided to sub bands using a nondecimated filter bank. In some embodiments the band and sub-band division is nonuniform and psychoacoustically motivated. In other words in some embodiments the separation between high and low frequency bands and furthermore the separation of frequency components from each of the high and low frequency bands may be determined using psychoacoustic principles.

The generation of the two channel/frequency bands from the digital audio signal and the recombination of the processed two channels into a single processed digital audio signal may be carried out in some embodiments by an analysis-synthesis filter bank structure designed where the filter bank filters are biorthogonal and the overall filter bank produces a small delay. In such embodiments the high frequency band does not require a synthesis filter, because the channel/frequency band is not decimated. Furthermore in these embodiments as there is only delay on the low frequency band due to the low frequency channel/band synthesis filter, this 'delay' can be utilized by the subband division of the high frequency band without adding any further delay to the overall structure.

Furthermore as in these embodiments the high frequency band/channel is not decimated, the sub-band filter bank that further divide the high frequency band into sub band components only require relatively small stop band attenuation levels. This in some embodiments results with an efficient structure with both short delay and low computational complexity As shown below in some embodiments the overall structure may have a delay of 5 ms meeting the minimum requirements for noise suppression used with the adaptive multi-rate (AMR) codec, a codec designed for speech processing. Furthermore although the 5 ms requirement is defined only for narrowband processing, this application also considers them as a good guideline for wideband processing.

A schematic representation of the structure of the digital audio processor in some embodiments is shown in further detail in FIG. 3.

The digital audio processor 101 may comprise an analysis filter section 281 which receives the digital audio signals and divides them into frequency bands, a first processing block 211 which receives the bands and performs a preliminary processing on the frequency band components, a sub-band generator section 285 which receives the processed frequency bands and divides the signals further into sub-bands, a second processing block 231 which receives the sub-band components and performs further processing, a sub-band combiner section 287 which receives the processed sub-band components and combines them back into frequency band components, a third processing block 251 which receives the frequency bands and performs some post-processing processing to the frequency band components and a synthesis filter section 283 which recombines the post-processed frequency band components to output a processed audio signal.

The analysis filter section 281 in some embodiments receives the digital signal from the analogue to digital converter 14 and as shown in FIG. 3, divide the digital signal into two frequency bands or channels. The two frequency bands or channels shown in FIG. 3 are a first (low frequency) band or channel 291 and a second (high frequency) band or channel 293. In some embodiments the low frequency channel may be up to 4 kHz (and requiring a sampling frequency of 8 kHz) and representing the frequency components of the narrowband signals and the high frequency channel 293 may be 4 kHz to 8 kHz (and therefore with a sampling frequency of 16 kHz) and representing the additional wideband signals.

The analysis filter section 281 may in some embodiments generate the frequency bands as indicated above. The analysis filter section 281 may in some embodiments comprise a first analysis filter $H_0$ 201 configured to receive the digital signal and output a filtered signal to a down-sampler 203. The configuration and design of the first analysis filter $H_0$ 201 will be discussed in detail later but may in some embodiments be considered to be a low pass filter with a defined threshold frequency at the low frequency band/high frequency band threshold.

The down-sampler 203 may be any suitable down-sampler. In some embodiments the down-sampler 203 is an integer down-sampler of value 2. The down-sampler 203 may then output a down-sampled output signal to a first processing block 211. In other words in some embodiments the down-sampler 203 selects and outputs every $2^{rd}$ sample from the filtered input samples to 'reduce' the sampling frequency to 8 kHz (or the narrowband sampling frequency) and outputs this filtered and down-sampled signal to the first processing block 211.

In some embodiments the first analysis filter $H_0$ 201 and the down-sampler 203 in combination may be considered to be a decimator for reducing the sampling rate from 16 kHz to 8 kHz.

The analysis filter section 281 may in some embodiments further comprise a second analysis filter $H_1$ 205 which receives the digital signal and outputs a filtered signal to a first processing block 211. The configuration and design of the second analysis filter $H_1$ 205 will also be discussed in detail later but may in some embodiments be considered to be a high pass filter with a defined threshold frequency at the low frequency band/high frequency band.

The division of the signal into frequency bands/channels using the analysis filters and down samplers is shown in FIG. 4 by step 305.

The first processing block 211 may receive the high 293 and low 291 frequency channels and in some embodiments perform beamforming processing and/or adaptive filtering on these signals. The first processing block may apply any suitable beamforming and/or adaptive filtering in order to implement applications such as acoustic echo control (AEC) and multi-microphone processing on the signal components from each of the frequency channels. In some embodiments it is possible to shorter adaptive filter in the adaptive filtering for the low frequency channel 291 because the low pass filtering followed by down-sampling of the audio signal allows a halving of the adaptive filter length. This can therefore improve the filtering process as shorter adaptive filters are known to perform better than longer ones in these types of applications. Furthermore as directivity cannot be utilized on higher frequencies both acoustic echo control (AEC) and multi-microphone processing applications carried out by the first processing block may be implemented so that beamforming and adaptive filtering for these application may be carried out on the low frequency band or channel signals only. In these embodiments the high frequency band/channel signals may implement the AEC and multi-microphone processing using sub-band frequency domain processing in the second processing block 231. This is because the frequency band where multi-microphone or microphone array processing is most effective depends on the distances between the microphones. Most often the distances in mobile devices are such that only lower frequencies are reasonable to process. Furthermore as in general, human hearing has logarithmic frequency interpretation better frequency resolution and higher processing fidelity may be used to produce better results for the lower frequencies.

The first processor 211 may in some embodiments carry out time domain processing on the low frequency band/channel components. For example the first processor may use time domain processing for voice activity detection (VAD) and specifically for some time-domain feature extraction. VAD can be considered as a general or high level control information, most of the speech/voice processing algorithms benefit from the information whether the signal is voice or something else. For example most typically VAD is used by noise suppressor (NS) applications to indicate when noise characteristics may be estimated (when there is no voice). The first processor 211 may perform the time domain processing on the low frequency band/channel signals as speech signals typically carry most of their information and energy on low frequency bands.

The pre-processing of at least one of the frequency bands/channels, for example the application of beamforming and/or adaptive filtering by the first processing block is shown in FIG. 4 by step 307.

The sub-band generator 285 may receive the output from the first processing block. In other words the sub-band generator may in some embodiments receive the processed high frequency band/channel at a filterbank 223 and receive the processed low frequency band/channel at a fast fourier transformer (FFT).

The fast fourier transformer 221 receives the processed low frequency band/channel signals, in other words a time domain signal band limited to the narrowband sampling frequency and performs a fast fourier transform to produce a frequency domain representation of the band limited processed audio signal. In a first example of some embodiments a low frequency band/channel signal may be sampled as a frame comprising 80 samples, in other words a 10 ms period sampled at 8 kHz. In some other embodiments the low frequency band/channel signal may be sampled as a frame with a frame length of 160 samples or 20 ms.

The frame is in some embodiments windowed, in other words multiplied by a window function. In these embodiments and because the windowing partly overlaps between frames, the overlapping samples are stored in memory for the next frame. In these embodiments the fast fourier transformer may combine these 80 samples for this frame with 16 samples stored from the previous frame, resulting in a total of 96 samples. In such embodiments the last 16 samples for this frame may be stored for calculating the next frame frequency coefficients. The FFT may in these embodiments take the 96 samples and multiply the samples by a window comprising 96 sample values, the 8 first values of the window forming the ascending strip of the window, and the 8 last values forming the descending strip of the window. The window function I may be any suitable function but in some embodiments may be defined as follows:

$$I(n)=(n+1)/9;n=0, \ldots ,7$$

$$I(n)=1;n=8, \ldots ,87$$

$$I(n)=(96-n)/9n=88, \ldots ,95$$

In some embodiments as the window function I(n) for the middle 80 sample values (n=8, . . . , 87) are =1, and accordingly multiplication by these function sample values does not change the audio signal sample values the multiplication can be omitted. In other words in these embodiments only the first 8 samples and the last 8 samples in the window need to be multiplied.

The FFT 221 furthermore may because the length of an FFT has to be a power of two, add 32 zeroes (0) at the end of the 96 samples obtained from block 11, resulting in a speech frame comprising 128 samples.

The samples x(0), x(1), . . . , x(n); n=127 (or said 128 samples) in the frame are transformed by the FFT 221 to the frequency domain employing real FFT (Fast Fourier Transform), giving frequency domain samples X(0), X(1), . . . , X(f); f=64 (more generally f=(n+1)/2), in which each sample comprises a real component $X_r(f)$ and an imaginary component $X_i(f)$:

$$X(f)=X_r(f)+jX_i(f);f=0, \ldots ,64$$

The FFT 221 in some embodiments may magnitude squared and add together the imaginary and real components in pairs to generate the power spectrum of the speech frame.

The FFT may then output the frequency component representation of the signals to the second processing block 231.

The filterbank 223 receives the high frequency band/channel signals and generates a series of signals with sufficient frequency resolution for noise suppression and other applications in the second processing block. The filterbank 223 may in some embodiments be implemented and/or designed under the control of the digital audio controller 105. In some embodiments of the invention the digital audio controller 105 may configure the filterbank 223 to be a cosine based modulated filterbank. This structure may be chosen to simplify the recombination process.

In some embodiments, the digital audio controller 105 may implement the filterbank 223 as a M'th band filter with a criteria which minimises a least squares value of the error between the filter and an ideal filter. In other words the sub-band filters may be chosen so to minimise the following equation:

$$\sum_{\omega\in\Omega} \lambda(\omega)|H_d(\omega) - H(\omega)|^2$$

where $\lambda(\omega)$ represents a weighting value, $H_d(\omega)$ refers to the ideal filter, Ω refers to a grid or range of frequencies and $H(z)=\Sigma h_k z^{-k}$ is an Mth band filter. The filterbank 223 may be in embodiments symmetrical about a mid tap l, such that $$h_l = \frac{1}{M}$$

and $h_{l\pm kM}=0$. The digital audio controller 105 may in some embodiments choose a suitable value for M dependent on the number and width of the sub-bands of the cosine based modulated filter bank. The digital audio controller 105 may in some embodiments combine sub-bands generated by the filter bank as the input signal has 'meaningful' content only on certain frequencies. The digital audio controller 105 may implement this configuration in these embodiments by merging neighbouring sub-bands by adding up the corresponding filter bank filter coefficients.

Figure 7:
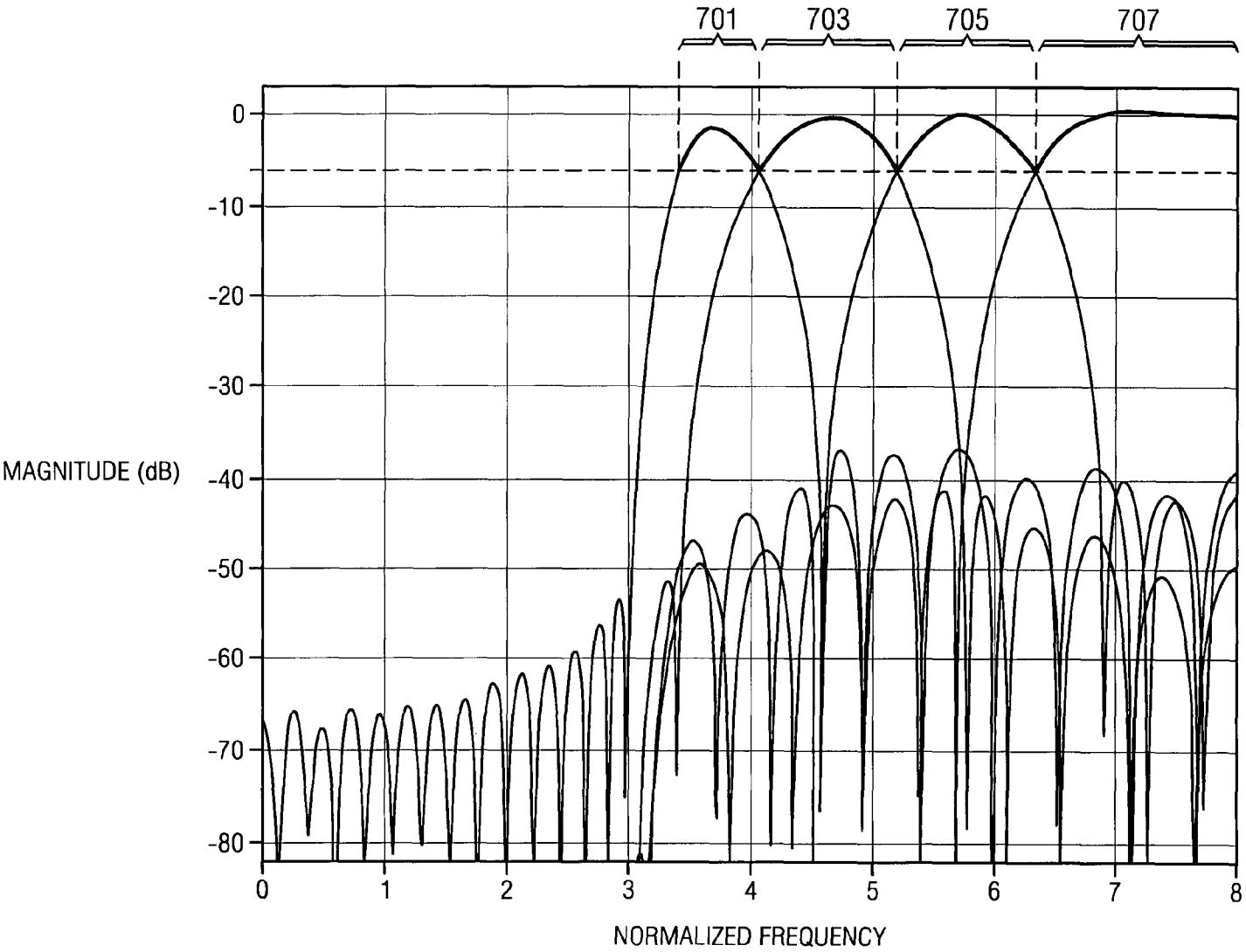
FIG. 7 shows schematically typical frequency responses depicting the sub-band filter bank responses according to some embodiments of the invention.
Figure 8:
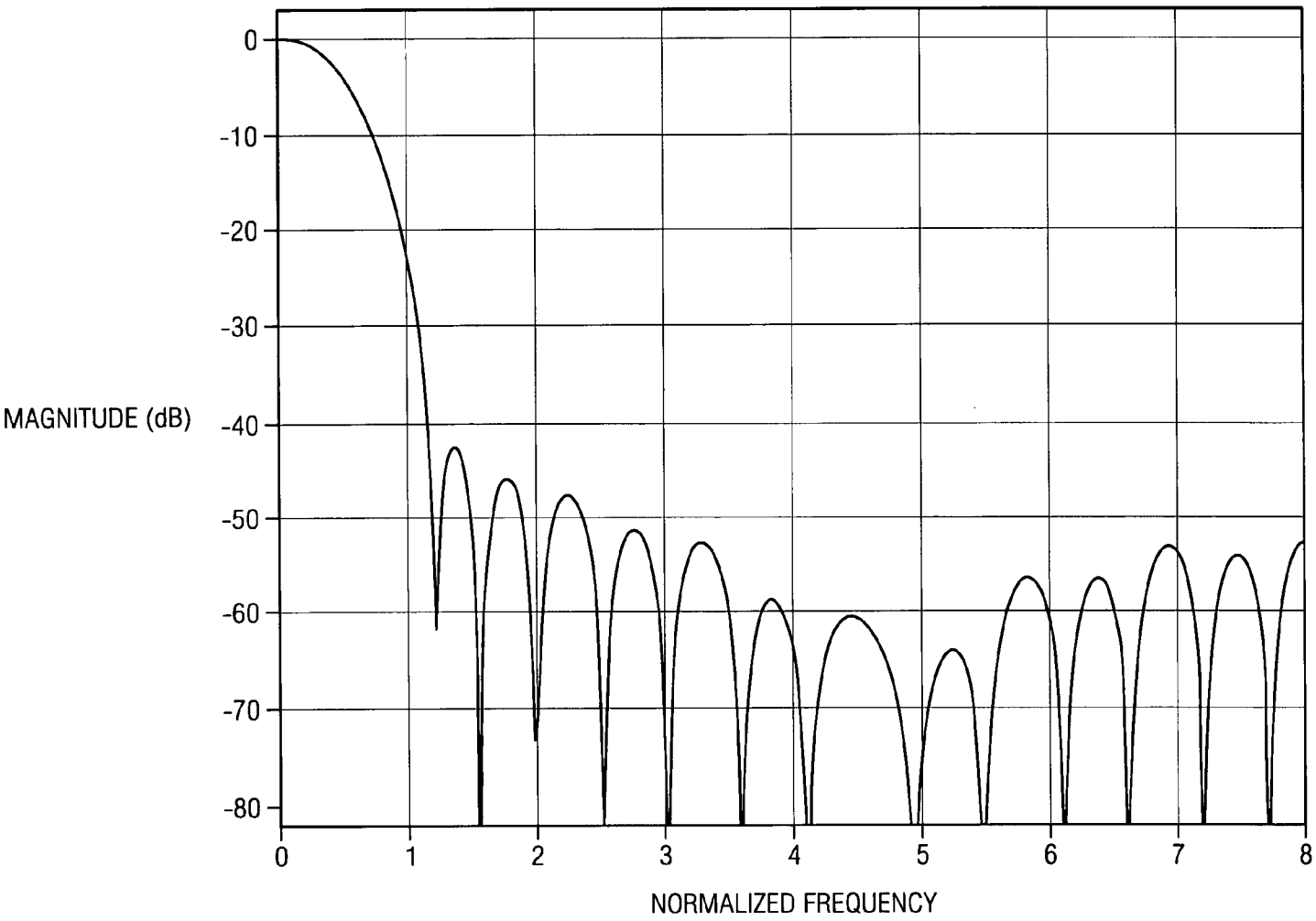
FIG. 8 shows schematically a typical frequency response depicting the magnitude response of a prototype sub-band filter according to some embodiments of the invention.

FIG. 7 shows an example of a filterbank 223 frequency response. All of the filters are convolved with $H_1(z)$, with the lowest four and the highest two bands are merged by adding up the corresponding filterbank coefficients. The filterbank output for the four sub-bands is highlighted by a first sub-band region 701 from approximately 3.4 kHz to 4 kHz, a second sub-band region 703 from approximately 4 kHz to 5.1 kHz a third sub-band region 705 from approximately 5.1 kHz to 6.3 kHz, and a fourth sub-band region 707 from approximately 6.3 kHz to 8 kHz. In some embodiments the digital audio controller may design the filter bank filters with moderate stopband attenuation of the filterbank filters as there is no decimation or interpolation and therefore no additional aliasing to prevent.

FIG. 4 furthermore shows the magnitude response for a prototype Mth band filter (in this example M=14) used as a starting point for the above filterbank filters.

It may be appreciated that although the filterbank has a relatively short delay for a filterbank, it still produces a delay. However, these delay from the filterbank is insignificant and may not determine the total delay of the system because typically the delay generated from the FFT 221 will be greater. Thus in some embodiments an extra delay filter $Z^{-D}$ 265 may be needed in the synthesis filter section to compensate for the FFT 221 delay.

The dividing of the bands into sub-bands is shown within FIG. 4 in step 309.

The output of these sub-band division is passed to the second processing block 231.

The second processing block 231 is configured to process the sub-band signals to perform noise suppression and for residual echo attenuation. The second processing block may in some embodiments compute signal powers on each sub-band for the high frequency band signals and use them with the power spectral density components for each low frequency band sub-band.

The second processing block 231 may in some embodiments be configured to perform noise suppression using any suitable noise suppression technique techniques such as the techniques shown in U.S. Pat. No. 5,839,101, or US-2007/078645.

The second processing block 231 may in some embodiments apply any suitable residual echo suppression processing to the sub-band components from the FFT 221 and the filterbank 223.

The application of the second processing block 231 in order to apply processing to at least one sub-band for noise suppression and/or echo suppression is shown in FIG. 4 by step 311.

The sub-band combiner 287 comprises an inverse fast fourier transformer 241 and a summation section 243.

The inverse fast fourier transformer (IFFT) 241 receives the low frequency band processed sub-bands and applies an inverse fast fourier transform to generate a time domain low frequency band representation. The inverse fast fourier transform may be any suitable inverse fast fourier transform. The IFFT 241 outputs the low frequency band signal information to the third processing block 251.

The summation section 243 receives the high frequency band processed sub-bands and adds the components together to generate a high frequency band/channel signal. The summation section outputs the high frequency band signal information to the third processing block 251.

The recombination of the processed sub-bands to generate processed bands is shown in FIG. 4 by step 313.

The third processing block receives the low frequency band/channel information from the IFFT 241 and the high frequency band/channel information from the summation section 243 and performs post processing on the signals. The third processing block 251, in some embodiments, performs signal level control. The implementation for level control in some embodiments are firstly, when summing or combining the signals later on there may be an overflow when fixed-point representation is used. This overflow condition may in these embodiments be estimated and the signal levels reduced accordingly by the third processing block. Secondly, in these embodiments, the signal levels can be varied, for example, depending on the microphone and the speaker distance, and can be controlled by the third processing block 251 in such a way that the listener has always an optimal and stable volume level.

The output of the third processing block 251 is passed to the synthesis filter section 283.

The application of the third processing block 251 is shown in FIG. 4 by step 315.

The synthesis filter section 283 in some embodiments receive the processed digital audio signal divided into frequency bands and filter and combine the bands to generate a single processed digital audio signal.

As shown in FIG. 3, the synthesis filter section 283 in some embodiments comprises a upsampler 261 configured to receive the low frequency band/channel signal output of the processing block and output an upsampled version suitable for combination with the high frequency band/channel signals. In some embodiments the upsampler 261 is an integer upsampler of value 2. In other words the upsampler 261 adds a new sample between ever pair of samples to 'increase' the sampling frequency from 8 kHz to 16 kHz. The upsampler 261 may then output an upsampled output signal to a first synthesis filter $F_0$ 263.

The first synthesis filter $F_0$ 263 receives the upsampled signal from the upsampler 263 and outputs a filtered signal to a first input of a combiner 267. The configuration and design of the first synthesis filter $F_0$ 263 will also be discussed in detail later but may in some embodiments be considered to be a low pass filter with a defined threshold frequency at the low frequency band/high frequency band boundary.

In some embodiments the first synthesis filter $F_0$ 263 and the upsampler 261 in combination may be considered to be a interpolator for increasing the sampling rate from 8 kHz to 16 kHz.

a second synthesis filter $F_1$ 265 (which in some embodiments may be a pure delay filter designated $z^{-D}$) is configured to receive the output from the high frequency band output from the third processing block 251 and output a filtered signal to a second input of the combiner 267. The configuration and design of the second synthesis filter $F_1$ 265 will be discussed in detail later but may in some embodiments be considered to be a pure delay filter with a defined delay sufficient to synchronize with the output of the first synthesis filter $F_0$ 263.

The combiner 267 receives the filtered processed high frequency band signals and filtered processed low frequency band signals and outputs a combined signal. In some embodiments this output is to the digital audio encoder 103 for further encoding prior to storage or transmitting.

The operation of combining the processed band is shown in FIG. 4 by step 317.

The digital audio encoder 103 may further encode the processed digital audio signal according to any suitable encoding process. For example the digital audio encoder 103 may apply any suitable lossless or lossy encoding process such as any of the International Telecommunications Union Technical board (ITU-T) G.722 or G729 coding families. In some embodiments the digital audio encoder 103 is optional and may not be implemented.

The operation of further encoding of the audio signal is shown in FIG. 4 by step 319.

The digital audio controller 105 according to embodiments of the invention may be configured to choose the parameters for implementing filters $H_0$, $H_1$, $F_0$ and $F_1$. In audio signals there may be generally very strong components on the lowest frequencies. These components may be mirrored onto the high band frequencies during any interpolation process. In other words the interpolation filters (the synthesis filters) $F_0$ and $F_1$ may be configured by the digital audio controller to have one or more zeros which correspond to the strongest minor frequencies and attenuate these mirrored components. The configuration of the filters by the digital audio controller may be performed before the audio processing described above and may be performed once or more than once depending upon the embodiments.

For example the digital audio controller 105 in some embodiments may be a separate device to the digital audio processor and on factory initialization and testing procedures the digital audio controller 105 configures the parameters of the digital audio processor before being removed from the apparatus. In other embodiments the digital audio controller is capable of reconfiguring the digital audio processor as often as required by the apparatus or user. For example if the apparatus is initially configured for high fidelity capture of speech in low noise environments the controller may be used to reconfigure the apparatus and the digital audio processor for speech audio capture to in high noise environments with echo rich environments.

The configuration or setting of the filters by the digital audio controller 105 can be seen with reference to FIG. 5 where the determining of the implementation parameters for the filters $H_0$ 201, $H_1$ 205, $F_0$ 263 and $F_1$ 265.

With respect to the apparatus shown in FIG. 3, if an input to the digital audio processor 101 is defined as X(z) and the output from the digital audio processor 101 as Y(z) in the Z domain, the discrete Laplace domain, then the input-output relationship for the outer parts of the filterbanks (if we assume there is no processing within the processing block and the inner filterbank) may be expressed as the following equation:

$$Y(z) = \frac{1}{2}F_0(z)H_0(z)X(z) + \frac{1}{2}F_0(z)H_0(-z)X(-z) + F_1(z)H_1(z)X(z)$$

The controller seeks in some embodiments to make the output a delayed version of the input with low distortion, in other words $$Y(z) \approx z^{-L}X(z)$$

where L refers to the delay produced by the filters.

The digital audio controller 105 configures the synthesis filters $F_1$ 265 and $F_0$ 263 to be time reversed versions of the analysis filters $H_1$ 205 and $H_0$ 201 respectively.

This initial assumption operation can be seen in FIG. 5 by step 501.

The digital audio controller 105 using this assumption now attempts to initially calculate the parameters for the analysis filters $H_0$ and $H_1$ using the following expression:

$$\min_{H_0,H_1} \lambda_0 \int_{\omega_0}^{\pi} |H_0(\omega)|^2 + \lambda_1 \int_0^{\omega_1} |H_1(\omega)|^2$$
$$\text{s.t.} \left| \frac{1}{2}|H_0(\omega)|^2 + |H_1(\omega)|^2 - 1 \right| \le \delta(\omega),\ \omega \in \Omega$$

where Ω refers to a grid of frequencies, δ(ω) defines the distortion allowed in each of these frequencies, $\omega_0$ and $\omega_1$ refer to the stop band edges of the low and high frequency bands respectively and $\lambda_0$ and $\lambda_1$ represent weighting function values.

The digital audio controller 105 may now consider this minimisation to be expressed as a semidefinite programming (SDP) problem of which a unique solution may be found using any known semidefinite programming solution.

Thus in some embodiments the controller may determine initial filter parameters which minimise the stop band energy with the constraint of only having one small overall distortion and which also forces the pass band value close to unity.

The operation of determining $H_0$, $H_1$ filter parameters by minimising stop band energy with only one small overall distortion criteria can be seen in FIG. 5 by step 503.

The digital audio controller 105 may then remove the assumption that the synthesis filters $F_1$ 265 and $F_0$ 263 are time reversed versions of the analysis filters $H_1$ 205 and $H_0$ 201 respectively.

The digital audio controller 105 may in some embodiments initialise an iterative step process.

The digital audio controller may determine parameters for the first synthesis filter $F_0$ 263 and the second analysis filter $H_1$ 205 with a fixed first analysis filter $H_0$ 201, using the following expression:

$$\min_{F_0,H_1} \lambda_2 \int_{\omega_0}^{\pi} |F_0(\omega)|^2 + \lambda_1 \int_0^{\omega_1} |H_1(\omega)|^2$$
$$\text{s.t.} \left| \frac{1}{2}H_0(\omega)F_0(\omega) + H_1(\omega)e^{-j\omega D} - e^{-j\omega L} \right| \le \delta(\omega),\ \omega \in \Omega$$

with fixed $H_0(\omega)$.

The operation of the first part of the iteration where the filters parameters for $F_0$ and $H_1$ are selected with respect to a fixed $H_0$ is shown in FIG. 5 by step 505.

The controller 105 in the second part of the iteration then attempts to determine parameters for the second analysis filter $H_1$ 205 and the first analysis filter $H_0$ 201 with a fixed first synthesis filter $F_0$ 263 with respect to the following equation:

$$\min_{H_0,H_1} \lambda_0 \int_{\omega_0}^{\pi} |H_0(\omega)|^2 + \lambda_1 \int_0^{\omega_1} |H_1(\omega)|^2$$
$$\text{s.t.} \left| \frac{1}{2}H_0(\omega)F_0(\omega) + H_1(\omega)e^{-j\omega D} - e^{-j\omega L} \right| \le \delta(\omega),\ \omega \in \Omega$$

where there is a fixed $F_0(\omega)$.

The operation of determining parameters for the first and second analysis filters $H_1$ 205 and $H_0$ 201 with a fixed first synthesis filter $F_0(\omega)$ is shown in FIG. 5 by step 507.

Both of the above iterative process operations may be expressed as a second order cone (SOC) problem and solved iteratively by the controller 105. As before $\Omega$ refers to a grid of frequencies, $\delta(\omega)$ defines a parameter which controls how much distortion is allowed in each of the frequencies, $\omega_0$ and $\omega_1$ refer to the low and high frequency band edge frequencies respectively and $\lambda_0$, $\lambda_1$ and $\lambda_2$ represent weighting functions.

The digital audio controller 105 may thus attempt to minimise the stop band energy with the constraint to have only one overall small distortion. This process may force the pass band close to one.

The digital audio controller 105 may then perform a check step to determine whether or not the filters generated by the current parameters are acceptable with respect to predefined criteria. The check step is shown in FIG. 5 by step 509.

Where the check step determines that the filters are acceptable, the operation then passes to step 511. Where the check step determines that further iteration is required, the digital audio controller 105 passes back to the first part of the iteration determining the parameters for the synthesis filter $F_0$ and analysis filter $H_1$ with respect to a fixed $H_0$.

The iterative process may depend very much on the initialisation processes. In tests performed by the inventors it has been observed that shorter initial filters $H_0$ and $H_1$ provide generally better solutions. Furthermore the digital audio controller 105 may use a time reversed $H_0$ (in other words a maximum phase filter) as an initial estimate for the $F_0$ filter where time synchronisation between the sub-bands is important.

With respect to the overall delay L produced by the filters, the digital audio controller 105 may set the value according to any suitable value. Also as indicated previously the digital audio controller 105 may determine parameters for the second synthesis filter $F_1$, dependent on the length of $H_1$ filter. The determination of the $F_1$ parameters is shown in FIG. 5 by step 511. In some embodiments the group delay of $H_1$ and the filter $F_1$ will determine approximately to the value defined for L. The digital audio controller 105 may in some embodiments determine the parameters for the first analysis filter bank outer part filter $H_1$ to have approximately linear phase, in other words having a constant delay. The controller 105 may in some embodiments determine filter parameters so that the filters $H_0$ 201 and $F_0$ 263 delay may differ between frequencies but have a convolved filter characteristic $H_0(z)F_0(z)$ having an approximately constant delay L on all frequencies.

Figure 6:
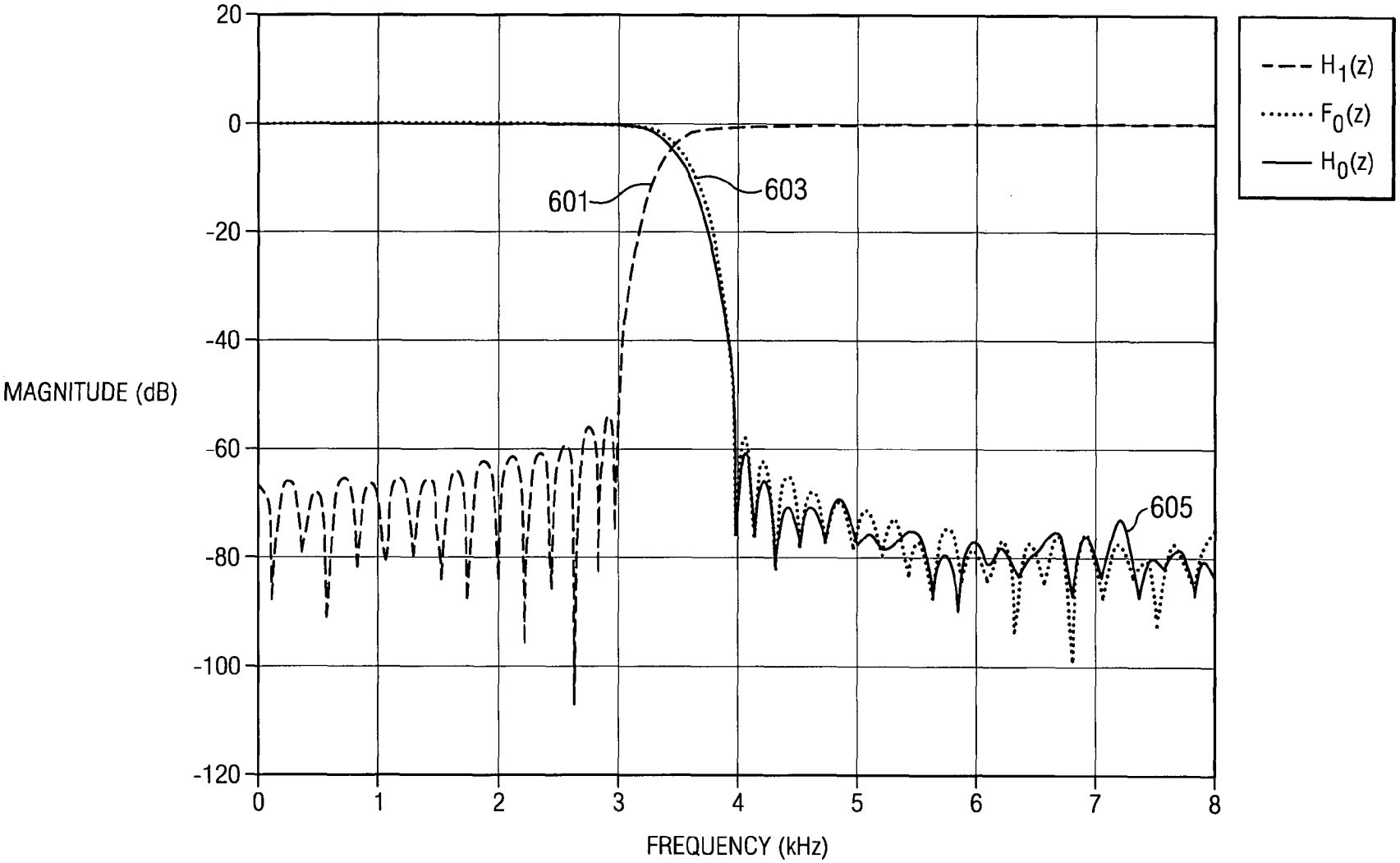
FIG. 6 shows schematically typical frequency responses depicting the audio enhancement digital processor filter responses according to some embodiments of the invention.

With respect to FIG. 6, suitable frequency responses for the first synthesis filter $F_0$ 263, the first analysis filter $H_1$ 205 and second analysis filter $H_0$ 201 are shown. In these examples the high frequency band analysis filter, the second analysis filter $H_1$ 205, frequency response is marked by the dashed line 601 and has a pass band from 3.2 kHz upwards. The low frequency band analysis filter, the first analysis filter $H_0$ 201, frequency response is shown by the trace marked by crosses '+' 605 and is shown with a stop band approximately from 4 kHz. The low frequency band synthesis filter, the second synthesis filter $F_0$ 263, frequency response is defined by the trace marked by crosses 'x' 705 is shown with shown with a stop band from 3.2 kHz.

The digital audio controller 105 in some embodiments focuses on the interpolator filter, the first synthesis filter $F_0$ 263, because the typical audio signal low frequency components are relatively strong and in these embodiments the controller may configure the filter $F_0$ 263 to significantly attenuate the low frequency components mirror images.

The digital audio controller 105 may in some embodiments increase the weighting for $\lambda_2$ in the first optimisation of the iterative step which may subsequently increase the stop band attenuation of the first synthesis filter $F_0$ 263.

The determining of implementation parameters for the analysis filter bank outer part filters and the synthesis filter bank outer part filters is shown in FIG. 5 by step 401.

Although the above examples show three separate processing blocks 211, 231, 251. It would be appreciated that in some embodiments only the operation of the second processing block 231 is required and therefore there may be no first nor third processing block. For example the post processing signal level control operations described above may not be carried out or may in some embodiments be carried out as part of the second processing block 231 operations. Similarly the pre processing operations in some embodiments may not be carried out in the first processing block 221 but may be carried out as part of the second processing block 231.

The above embodiments may be implemented using microphone array processing or beamforming (mentioned above) where multiple microphones are required and, thus, stereo or polyphonic signals are implemented. In other words some embodiments receive multiple signals as an input, but provide fewer outputs. In some embodiments the fewer outputs may be just a mono output. Furthermore in some embodiments the frequency range for the beamforming is using implements similar frequency division methods for all the inputs. In these embodiments the background noise estimate is computed first for all of the channels or pairs of channels and for each band, then for each band the smaller value is stored as the background noise estimate. In these embodiments where the aim is to attenuate the distant noise sources the noise cancelling operation such as performed by the second processing block 231 does not suppress the audio information where the recording source or signal origin is close to the recording device that the audio level is significantly different at different microphones or recording points.

Although the above describes the apparatus and the digital audio processor 103 with a specific structure it would be understood that there may be many alternative implementations possible according to the embodiment.

In some embodiments the sampling rate for any of the high or low frequency bands may differ from the values described above. For example in some embodiments the high frequency band may have a sampling frequency of 48 kHz.

Furthermore in some embodiments, the input signal may be a 44.1 kHz sampled signal, in other words a compact disc (CD) formatted digital signal. In these embodiments, the low bands using the structured described in the embodiments above may be considered to have a 22.1 kHz (low frequency band) sampling rates.

Furthermore as the number and size of the sub-bands on the main band is dictated by the requirements of the noise suppression, other embodiments may use different numbers of sub-bands and sub-bands with different sub-band widths.

In some embodiments of the invention, more than the two bands shown in the embodiments described above may be used. For example in some embodiments in order to obtain sufficient frequency resolution for suppressing stronger noise for lower frequency components the low frequency band may be further divided. For example in these embodiments the low band 0 to 4 kHz may be divided into a high-low band 2 kHz to 4 kHz and a low-low band up to 2 kHz.

In some embodiments the cosine based modulated filter banks described for operation in the sub-band filters may use a higher or lower value of M for the prototype filter and combine suitable filter coefficients to produce the sub-band distribution required.

The digital audio processor 101 when controlled by the digital audio controller 105 according to the above embodiments thus may be able to generate enhanced wideband speech audio signals with improved quality and with Quantization noise down by 10-20 dB over conventional approaches according to simulations. This reduction in Quantization noise is now practically vanished or unperceivable to the normal user. Furthermore the apparatus shown above enables an audio enhancement system with lower computational complexity to be used, which assists in the constant demand for power efficiencies to enable devices to be cheaper and have longer operational times without increasing battery capacity.

These embodiments furthermore may be designed so that there is a short delay, compared to other kinds of filterbank structures thus relaxing the processing time constraints for signal encoding for transmission or storage of speech signals.

In the embodiments described above as adaptive filtering has already been carried out on the decimated band and therefore the outer 2-channel analysis-synthesis filterbank is needed, The particular layout/implementation of the frequency division framework may provide many division possibilities such as shown in the above embodiments by processing blocks 1, 2 and 3. These division possibilities may in some embodiments be flexibly used by the algorithms in a way that band usage and computational needs are optimized.

Some embodiments furthermore may reduce the need for static memory as compared against previous filterbank systems, for example a structure where two channel analysis-synthesis filterbanks are followed by FFT-based processing on a resynthesized wideband signal.

Although the above examples describe embodiments of the invention operating an within an electronic device 10 or apparatus, it would be appreciated that the invention as described below may be implemented as part of any audio processing stage within a chain of audio processing stages.

Thus in some embodiments there is a method comprising the operations of filtering an audio signal into at least two frequency band signals, and generating for each frequency band signal a plurality of sub-band signals. In such embodiments for at least one frequency band signal the plurality of sub-band signals are generated using a time to frequency domain transform and for at least one other frequency band the plurality of sub-band signals for the one other frequency band are generated using a sub-band filterbank.

Furthermore in some embodiments there is an apparatus comprising at least one processor and at least one memory including computer program code the at least one memory and the computer program code configured to, with the at least one processor, cause the apparatus at least to perform the operations described above.

In some further embodiments there is apparatus comprising a filter configured to filter an audio signal into at least two frequency band signals; a time to frequency domain transformer configured to generating for at least one frequency band signal a plurality of sub-band signals; and a sub-band filterbank configured to generate for at least one other frequency band the plurality of sub-band signals.

Furthermore user equipment, universal serial bus (USB) sticks, and modem data cards may comprise audio enhancement apparatus such as the apparatus described in embodiments above.

It shall be appreciated that the term user equipment is intended to cover any suitable type of wireless user equipment, such as mobile telephones, portable data processing devices or portable web browsers.

Furthermore elements of a public land mobile network (PLMN) may also comprise apparatus as described above.

In general, the various embodiments described above may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of the application may be implemented by computer software executable by a data processor, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example digital versatile disc (DVD), compact discs (CD) and the data variants thereof both.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process.

Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

As used in this application, the term circuitry may refer to all of the following: (a) hardware-only circuit implementations (such as implementations in only analogue and/or digital circuitry) and (b) to combinations of circuits and software (and/or firmware), such as and where applicable: (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of circuitry applies to all uses of this term in this application, including in any claims. As a further example, as used in this application, the term circuitry would also cover an implementation of merely a processor (or multiple processors) or portion of a processor and its (or their) accompanying software and/or firmware. The term circuitry would also cover, for example and if applicable to the particular claim element, a baseband integrated circuit or applications processor integrated circuit for a mobile phone or a similar integrated circuit in server, a cellular network device, or other network device.

The term processor and memory may comprise but are not limited to in this application: (1) one or more microprocessors, (2) one or more processor(s) with accompanying digital signal processor(s), (3) one or more processor(s) without accompanying digital signal processor(s), (3) one or more special-purpose computer chips, (4) one or more field-programmable gate arrays (FPGAS), (5) one or more controllers, (6) one or more application-specific integrated circuits (ASICS), or detector(s), processor(s) (including dual-core and multiple-core processors), digital signal processor(s), controller(s), receiver, transmitter, encoder, decoder, memory (and memories), software, firmware, RAM, ROM, display, user interface, display circuitry, user interface circuitry, user interface software, display software, circuit(s), antenna, antenna circuitry, and circuitry.

The invention claimed is:

1. A method comprising:

filtering an audio signal into at least a first frequency band signal and a second frequency band signal, wherein frequencies of the first frequency band signal are lower than frequencies of the second frequency band signal;

decimating the first, lower frequency band signal to produce a down-sampled first, lower frequency band signal;

generating for the down-sampled first, lower frequency band signal, a plurality of sub-band signals using a time to frequency domain transform;

generating for the second, higher frequency band signal, a plurality of non-decimated sub-band signals using a non-decimating sub-band filterbank;

applying in the frequency domain noise suppression or echo suppression to at least one sub-band signal generated for the down-sampled first, lower frequency band signal using the time to frequency domain transform;

applying in the time domain noise suppression or echo suppression to at least one non-decimated sub-band signal generated for the second, higher frequency band signal using the non-decimating sub-band filterbank;

combining the sub-band signals generated using the time to frequency domain transform, including the at least one noise or echo suppressed sub-band signal, to form a processed lower frequency band audio signal;

combining the non-decimated sub-band signals generated using the non-decimating sub-band filterbank, including the at least one noise or echo suppressed sub-band signal, to form a processed higher frequency band audio signal; and combining the processed lower frequency band audio signal and the processed higher frequency band signal to generate a processed audio signal.

2. The method as claimed in claim 1, wherein the time to frequency domain transform comprises one of:

a fast Fourier transform;

a discrete Fourier transform; and a discrete cosine transform.

3. The method as claimed in claim 1, wherein the non-decimating sub-band filterbank is a cosine based modulated filterbank.

4. The method as claimed in claim 1, wherein filtering an audio signal into at least the first and second frequency band signals comprises:

high-pass filtering the audio signal into the second frequency band signal; and low-pass filtering the audio signal into the first frequency band signal.

5. The method as claimed in claim 1, wherein the decimating the first, lower frequency band signal to generate the down-sampled first, lower frequency band signal is by a factor of 2.

6. The method as claimed in claim 1, wherein combining the sub-band signals generated using the time to frequency domain transform to form the processed lower frequency band audio signal comprises:

generating using a frequency to time domain transform the processed lower frequency band audio signal; and wherein combining the non-decimated sub-band signals generated using the non-decimating sub-band filterbank to form the processed higher frequency band signal comprises:

summing the non-decimated sub-band signals generated using the non-decimating sub-band filterbank.

7. The method as claimed in claim 1, wherein combining the processed higher and lower frequency band audio signals to generate a processed audio signal further comprises:

upsampling the processed lower frequency band signals;

low pass filtering the upsampled processed lower frequency band signal; and combining the low pass filtered, upsampled, processed lower frequency band signal with the processed higher frequency band signal to generate the processed audio signal.

8. The method as claimed in claim 7, wherein upsampling the processed lower frequency band signals is by a factor of 2.

9. The method as claimed in claim 7, wherein combining the low pass filtered, upsampled, processed lower frequency band signal with the processed higher frequency band signal to generate the processed audio signal further comprises delaying the processed higher frequency band signal.

10. The method as claimed in claim 1, further comprising, prior to combining the processed higher and lower frequency band audio signals to generate a processed audio signal, processing the sub-band signals forming the processed higher and lower frequency band audio signals, wherein the processing of the sub-band signals comprises signal level control on the sub-band signals.

11. The method as claimed in claim 7, further comprising configuring filters comprising:

high-pass filtering by a first filter of the audio signal into the second, higher frequency band signal;

low-pass filtering by a second filter of the audio signal into the first, lower frequency band signal; and low pass filtering by a third filter of the upsampled processed lower frequency band signal.

12. The method as claimed in claim 1, further comprising:

processing the first and second frequency band signals prior to generating for each frequency band signal the plurality of sub-band signals, wherein the processing of the first and second frequency band signals comprises at least one of:

audio beamforming processing; and adaptive filtering.

13. An apparatus comprising at least one processor and at least one memory including computer program code, the at least one memory and the computer program code configured to, with the at least one processor, cause the apparatus at least to:

filter an audio signal into at least a first frequency band signal and a second frequency band signal, wherein frequencies of the first frequency band signal are lower than the frequencies of the second frequency band signal;

decimate the first, lower frequency band signal to produce a down-sampled first, lower frequency band signal;

generate for the down-sampled first, lower frequency band signal, a plurality of sub-band signals using a time to frequency domain transform;

generate for the second, higher frequency band signal, a plurality of non-decimated sub-band signals using a non-decimating sub-band filterbank;

apply in the frequency domain noise suppression or echo suppression to at least one sub-band signal generated for the down-sampled first, lower frequency band signal using the time to frequency domain transform;

apply in the time domain noise suppression or echo suppression to at least one non-decimated sub-band signal generated for the second, higher frequency band signal using the non-decimating sub-band filterbank;

combine the sub-band signals generated using the time to frequency domain transform, including the at least one noise or echo suppressed sub-band signal, to form a processed lower frequency band audio signal;

combine the non-decimated sub-band signals generated using the non-decimating sub-band filterbank, including the at least one noise or echo suppressed sub-band signal, to form a processed higher frequency band audio signal; and combine the processed lower frequency band audio signal and the processed higher frequency band signal to generate a processed audio signal.

14. The apparatus as claimed in claim 13, wherein the time to frequency domain transform comprises one of:

a fast Fourier transform;

a discrete Fourier transform; and a discrete cosine transform.

15. The apparatus as claimed in claim 13, wherein the non-decimating sub-band filterbank is a cosine based modulated filterbank.

16. The apparatus as claimed in claim 13, wherein when causing the apparatus to filter an audio signal into at least the first and second frequency band signals further comprises causing the apparatus to:

high-pass filter the audio signal into the second frequency band signal; and low-pass filter the audio signal into the first frequency band signal.

17. The apparatus as claimed in claim 16, wherein when causing the apparatus to decimate the first, lower frequency band signal to generate the down-sampled first, lower frequency band signal further comprises causing the apparatus to decimate by a factor of 2.

18. The apparatus as claimed in claim 13, wherein when causing the apparatus to perform combining the sub-band signals to form the processed lower frequency band audio signal further comprises causing the apparatus to:

generate using a frequency to time domain transform the processed lower frequency band audio signal;

and wherein causing the apparatus to combine the non-decimated sub-band signals generated using the non-decimating sub-band filterbank to form the processed higher frequency band signal comprises:

summing the non-decimated sub-band signals generated using the non-decimating sub-band filterbank.

19. The apparatus as claimed in claim 13, wherein when causing the apparatus to perform combining the processed higher and lower frequency band audio signals to generate a processed audio signal further comprises causing the apparatus to:

upsample the processed lower frequency band signal;

low pass filter the upsampled processed lower frequency band signal; and combine the low pass filtered, upsampled, processed lower frequency band signal with the processed higher frequency band signal to generate the processed audio signal.

20. The apparatus as claimed in claim 19, wherein when causing the apparatus to upsample the processed lower frequency band signal further comprises causing the apparatus to upsample by a factor of 2.

21. The apparatus as claimed in claim 19, wherein when causing the apparatus to combine the low pass filtered, upsampled, processed lower frequency band signal with the processed higher frequency band signal to generate the processed audio signal further comprises causing the apparatus to delay the processed higher frequency band signal.

22. The apparatus as claimed in claim 13, wherein the at least one processor, causes the apparatus at least to further process the sub-band signals forming the processed higher and lower frequency band signals prior to combining the processed higher and lower frequency band audio signals to generate a processed audio signal, wherein the process of the sub-band signals comprises signal level control on the sub-band signals.

23. The apparatus as claimed in claim 20, wherein the at least one processor, causes the apparatus at least to further configure filters comprises:

a first filter for high-pass filtering of the audio signal into the second higher frequency band signal;

a second filter for low-pass filtering of the audio signal into the first lower frequency band signal; and a third filter for low pass filtering of the upsampled processed lower frequency band signal.

24. The apparatus as claimed in claim 13, wherein the at least one processor, causes the apparatus at least to further:

process the first and second frequency band signals prior to generating for each frequency band signal the plurality of sub-band signals, wherein the processing of the first and second frequency band signals comprises at least one of:

audio beamforming processing; and adaptive filtering.

* * * * *